US005213170A

United States Patent [19]

Savitski

[11] Patent Number: 5,213,170

[45] Date of Patent: May 25, 1993

[54] FOOTING AUGER

[76] Inventor: Richard H. Savitski, 14525 88th St. Northeast, Elk River, Minn. 55330

[21] Appl. No.: 875,056

[22] Filed: Apr. 28, 1992

[51] Int. Cl.[5] ..... E21B 10/00; E21B 17/00

[52] U.S. Cl. ..... 175/323

[58] Field of Search ..... 175/323, 394, 421, 19

[56] References Cited

U.S. PATENT DOCUMENTS 1,118,733 11/1914 Brooks et al. ..... 175/323
2,613,062 10/1952 Harbert ..... 175/323
2,877,987 3/1959 Petersen ..... 175/323

FOREIGN PATENT DOCUMENTS 0678995 4/1966 Belgium ..... 175/323

OTHER PUBLICATIONS

Turfco Pipe Piper Boring Unit brochure (undated).
Little Beaver, Torque-Free One-Man Earth Drilling Unit, advertisment, *Rental Equipment Register*, p. 133 (Oct. 1990).
Groundhog Inc., Model D-5 Two-Man Drill, advertisement, *Rental Equipment Register*, p. 86 (Oct. 1990).
McMillen, Hydraulic Earth Drill Attachments, advertisement, *Rental Equipment Register*, p. 150 (Oct. 1990).
Bil-Jax, Inc., Yellow Jacket Earth Augers, advertisement, *Rental Equipment Register*, p. 151 (Oct. 1990).

*Primary Examiner*—Thuy M. Bui
*Attorney, Agent, or Firm*—Merchant, Gould, Smith, Edell, Welter & Schmidt

[57] ABSTRACT

A footing auger has a helical auger portion with a chuck on one end for attaching the footing auger to a rotating power tool, a rod-like pilot on the other end of the footing auger for guiding the footing auger in a predetermined direction, and forwardly directed hardened blade extensions attached to the helical auger portion and the pilot that are arranged and configured to chip the dirt or other substances from the desired hole.

17 Claims, 2 Drawing Sheets

FOOTING AUGER

FIELD OF INVENTION

This invention relates to augers, and more particularly to an auger for drilling underground holes beneath footings or other structures.

BACKGROUND OF INVENTION

Several systems, such as sewer connections or lawn irrigation systems, require pipes to be run beneath footings, sidewalks or other structures. The creation of the hole for the running of these pipes is currently performed by a workman using a tunneling spade. Unfortunately, depending on the length of the hole and the soil composition, this method can take between thirty minutes to an hour.

In addition, attempts at using a conventional augers to create these holes have proved unsuccessful. Conventional augers dig into the ground creating forces on the auger that tend to shift the auger from the desired boring direction. Because the auger must be supported in a horizontal position, these forces make it difficult for the user to create the straight, uniform hole that is required for the insertion of a pipe. Therefore, there arises a need for a tool that can quickly create straight, uniform holes beneath footings, sidewalks or other structures.

BRIEF SUMMARY OF INVENTION

The present invention is for an apparatus for use as a footing auger. The footing auger is made of a helical auger portion with a chuck on one end for attaching the footing auger to a rotating power tool, a rod-like pilot on the other end of the footing auger for guiding the footing auger in a predetermined direction, and blade extensions attached to the helical auger portion and the pilot that are arranged and configured to chip the dirt or other substances from the desired hole.

The invention enables the user to create a straight, uniform hole beneath a footing or other structure within two to three minutes, thereby eliminating the time and labor that arises when using a tunneling spade. In addition, because the invention chips the dirt from the hole instead of digging like a conventional auger, the footing auger is not subjected to the forces that tend to shift the auger from the desired boring direction. Therefore, the invention makes it easy for the user to create a straight, uniform hole.

DETAILED DESCRIPTION OF THE PREFERRED EMBODIMENT

Figure 5:
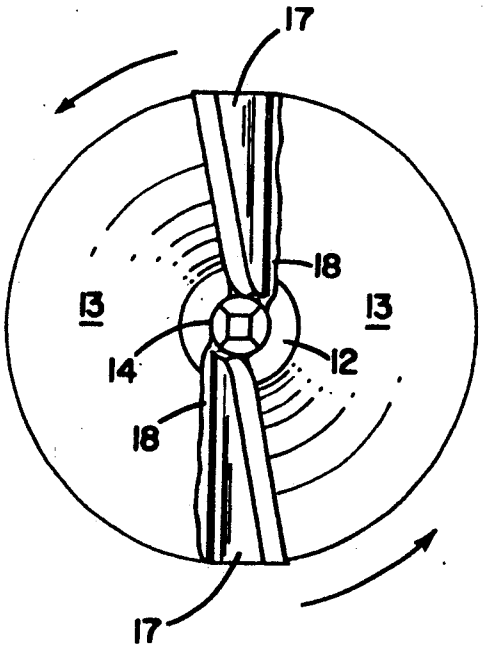
FIG. 5 is an end view taken from the right end of FIG. 3.
Figure 2:
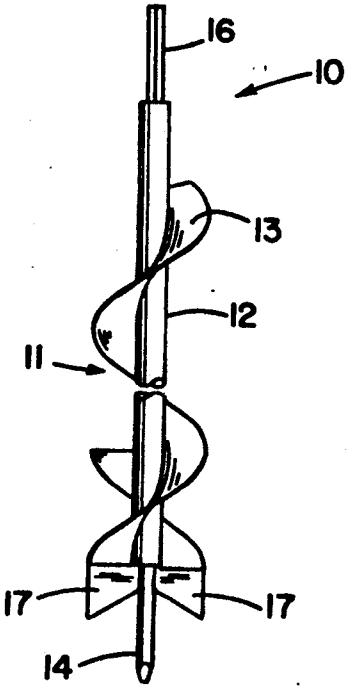
FIG. 2 is a view in side elevation of the preferred embodiment of the invention, a portion being broken away.
Figure 1:
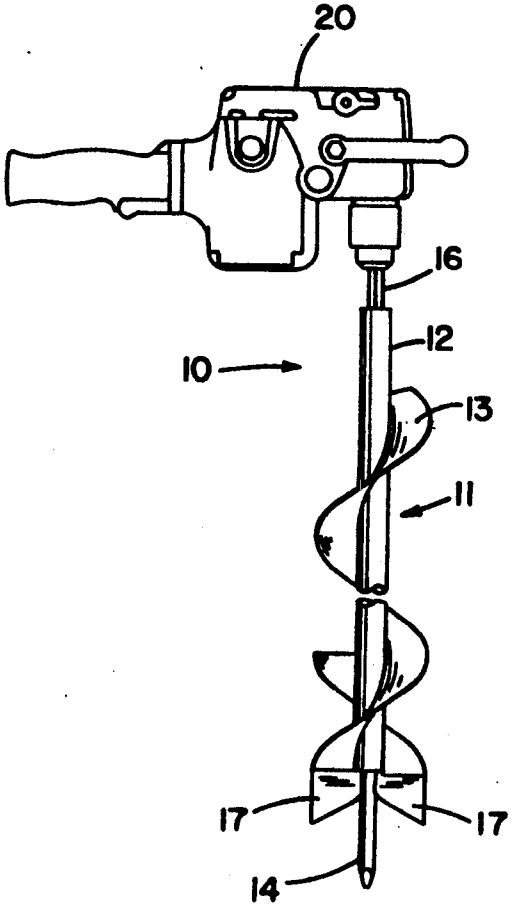
FIG. 1 is a view in side elevation of the preferred embodiment of the invention as shown when attached to a rotating power tool, a portion being broken away.

Referring to the drawings wherein like numerals designate like parts, the preferred embodiment of the invention is a footing auger, generally designated as 10, comprised of a helical auger portion 11, a chuck 16, a pilot 14, and blade extensions 17, FIGS. 1 and 2. In the preferred embodiment, the chuck 16 is a hardened steel rod-like member with a hexagonal cross-section to allow its attachment to a rotating power tool 20 such as a Milwaukee® Heavy-Duty Hole-Hawg®, a Black & Decker™ Timberwolf™ Right-Angle Drill or the like. The rotating power tool 20 is used to rotate the footing auger 10 in a counter clockwise direction when viewed as shown in FIG. 5. Those skilled in the art would recognize that the invention could be adapted for use with any rotating power tool 20.

Figure 3:
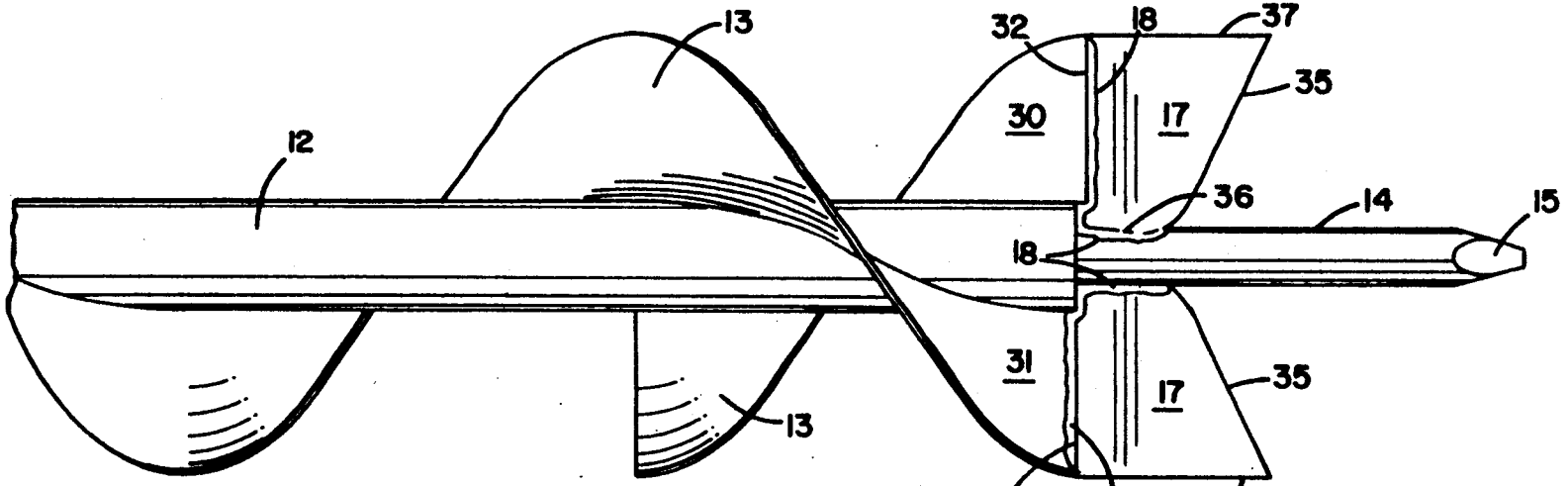
FIG. 3 is a fragmentary, enlarged view of the helical auger portion, blade extensions and pilot shown in FIGS. 1 and 2.
Figure 4:
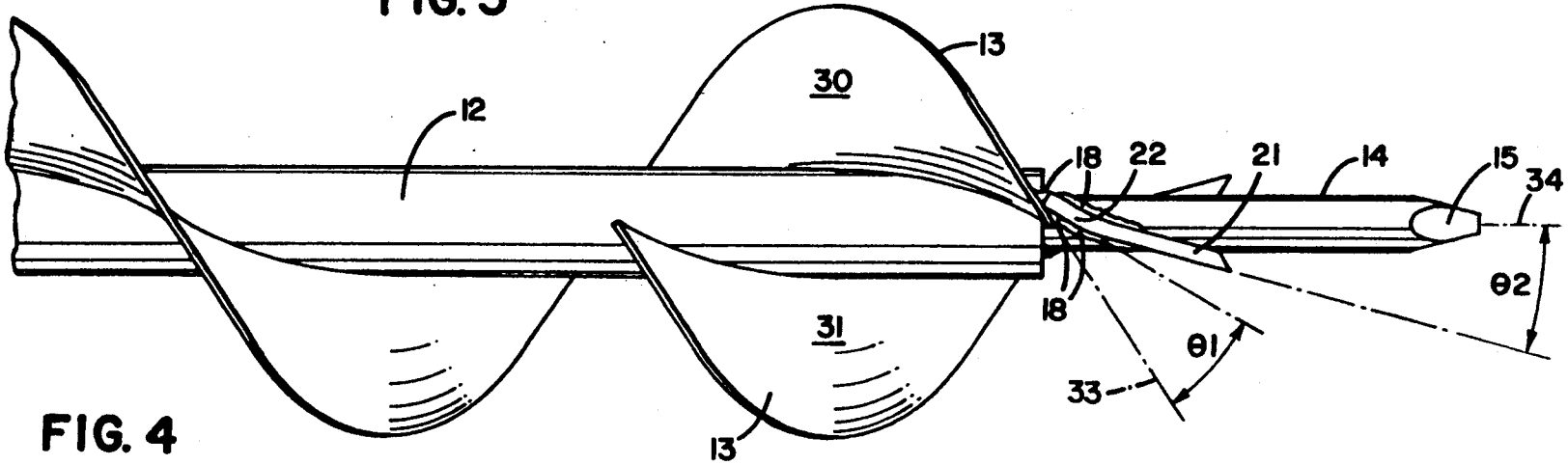
FIG. 4 is a view similar to FIG. 3 rotated 90 degrees.

Referring now to FIGS. 3 and 4, the helical auger portion 11 is comprised of a shaft 12 and two hardened steel helical flights 13 offset on the shaft 12 by 180°. The helical flights 13 have a first surface 30 facing in the direction of rotation, an oppositely facing surface 31 facing away from the direction of rotation, and a terminal end 32 that is generally perpendicular to the axis of the shaft 12 and generally located at the end of the shaft 12 adjacent to the pilot 14. The terminal end 32 also lies in a first plane 33 extending at an acute angle from a second plane 34 through an axis of the pilot 14. One helical flight 13 extends the entire length of the shaft 12, while the second helical flight 13 only extends along the shaft 12 until reaching a point 180° from its terminal end 32. Helical flights 13 with diameters up to five and one-quarter inches have been utilized with the invention, however, those skilled in the art will recognize that helical flights 13 with other diameters could be used to create holes for other pipe diameters.

The pilot 14 is a hardened steel member generally rod-like in shape and attached to the end of the shaft 12 so that the shaft 12 and pilot 14 have a common axis. In the preferred embodiment, the pilot 14 is welded to the shaft 12. The pilot 14 also has a pointed portion 15 at its distal end to enable the pilot 14 to be inserted into the ground.

Two blade extensions 17 having an upper portion 21 and a lower portion 22 are generally located near the pilot 14 and act to chip the dirt from the desired hole. The blade extensions 17 are preferably made from carbon steel to increase the durability of the blade extensions 17. The lower portion 22 of each blade extension 17 is attached to a helical flight 13 and the pilot 14. In the preferred embodiment, the blade extensions 17 are attached to the helical flights 13 and pilot 14 by weld joints 18.

In the preferred embodiment, the lower portion 22 of each blade extension 17 is attached to the oppositely facing surface 31 of a helical flight 13 by weld joints 18 so that the blade extension 17 extends from the helical flight 13 at an angle $\theta 1$ that is between 0–60 degrees, preferably around 30 degrees, from the first plane 33. This attachment method and angle provide the strength required for the attachment joint between the blade extensions 17 and the helical flights 13. The blade extensions 17 then curve to a upper portion 21 that extends at an angle $\theta 2$ that is between 0–45 degrees, preferably less than 20 degrees, from the second plane 34.

The front view of the preferred embodiment of the blade extensions 17, best shown in FIG. 3, indicate blade extensions 17 having a base edge 38 with a length equal to the distance between the pilot 14 and the outer radius of the helical flights 13 that is welded to the oppositely facing surface 31 of a helical flight 13, an inside edge 36 extending perpendicular to the base surface 38 and parallel to the second plane 34 that is welded to the pilot 14, an outside edge 37 generally located at a radius equal to the radius of the helical flight 13 extending perpendicular to the base surface 38 and parallel to the second plane 34, having a length greater than the length of the inside edge 36 and a forward cutting edge 35 sloping downward from the end of the outside edge 37 to the end of the inside edge 36.

Because of the small extension angle of the upper portion 21, the blade extensions 17 chip the dirt from the hole instead of quickly digging into the dirt like a conventional auger. In addition, the inward sloping design of the forward cutting edge 35 gradually chips a hole from the outside inward, reducing the forces exerted on the footing auger 10. Therefore, the invention is not subjected to the forces that cause conventional augers to shift from the desired boring direction. During experimentation, it was discovered that using end portions of lawn mower blades as the blade extensions 17 provided all of the features and durability required for the preferred embodiment.

The process of using the invention to create a hole underneath a footing or other structure begins by attaching the chuck 16 of the footing auger 10 to a rotating power tool 20. The pilot 14 is then placed into the ground at the center of the hole to be bored. The user then aligns the axis of the shaft 12 and pilot 14 with the desired axis of the hole to be created and slowly forces the footing auger 10 into the desired hole while operating the rotating power tool 20. When the desired length of the hole has been reached, the user removes the footing auger 10 leaving the desired hole for insertion of a pipe.

Although characteristics and advantages, together with details for structure, materials, function and process steps have been described in reference to a preferred embodiment herein, it is understood that the disclosure is illustrative. To that degree, various changes made, especially to matters of shape, size and arrangement, to the full extent extended by the general meanings of the terms in which the appended claims are expressed, are within the principles of the present invention.

What is claimed is:

1. A footing auger with first rearwardly directed and second forwardly directed ends for creating underground holes in the soil beneath footings or other structures comprising:

a. a helical auger portion having a shaft and helical flights, and having a terminal end and an outer radius;

b. a chuck located at said first end of said footing auger and attached to said shaft that is arranged and configured for attachment to a rotating power tool;

c. a rod-like pilot located at said second end of said footing auger and attached to said shaft having a pointed portion located at a distal end thereof;

d. two curved blade extensions having forwardly directed cutting edges; and e. means for attaching said extensions to said terminal end of said helical flights and to said pilot, each having an upper portion and a lower portion, wherein said lower portion of each said blade extension extends from one said helical flight at an angle from 0–60 degrees from a first plane tangential to a first surface of said helical flight and wherein said upper portion extends at an angle from 0–30 degrees as measured from a second plane parallel to an axis of said pilot.

2. A footing auger according to claim 1, wherein said blade extensions are welded to said helical flights and said pilot.

3. A footing auger according to claim 1, wherein said blade extensions are made from hardened carbon steel.

4. A footing auger according to claim 1, wherein said blade extensions have a width equal to the distance between said pilot and said helical flight outer radius.

5. A footing auger according to claim 1, wherein said blade extension are pieces of lawn mower blades with a width equal to the distance between said pilot and said helical flight outer radius.

6. A footing auger according to claim 1, wherein said blade extensions have an inside edge attached to said pilot, an outside edge generally greater in length than said inside edge located at said helical flight outer radius, a base edge attached to said terminal end of said helical flight and a forward cutting edge extending from said inside edge to said outside edge.

7. A footing auger according to claim 6, wherein said helical flights have a first surface facing in the direction of rotation and an oppositely facing surface and wherein said base edge of said blade extensions are welded to said opposite facing surface of said helical flights.

8. A footing auger with first and second ends and being rotatable for creating underground holes beneath footings or other structures comprising:

a. piloting means generally located at said second end for guiding said footing auger in a predetermined direction;

b. attachment means generally located at said first end for attaching said footing auger to a power means; and c. a helical auger located between and attached to said piloting means and said attachment means, having a shaft and helical flights on said shaft with blade extensions that are arranged and configured to chip dirt or other substances from the desired hole, wherein said flights have a first surface facing in the direction of rotation, an oppositely facing surface and a terminal end, each said flight at said terminal end extending generally in a first plane extending at an acute angle from a second plane through an axis of said piloting means, and wherein each said blade extension lies in a plane between said first and second planes and has a forward cutting edge.

9. A footing auger according to claim 8, wherein said attachment means is a hexagonal chuck.

10. A footing auger according to claim 8, wherein said piloting means is a generally rod-like pilot with a pointed portion at a distal end thereof.

11. A footing auger according to claim 8, wherein said blade extensions are curved extensions having a lower portion and a forward upper portion.

12. A footing auger according to claim 11, wherein said blade extensions are separate structures attached to said helical flights and said piloting means that are arranged and configured to have said lower portion extend from said helical flights at an angle from 0–60 degrees from said first plane and to have said upper portion extend at an angle from 0–30 degrees as measured from said second plane.

13. A footing auger according to claim 12, wherein said blade extensions are welded to said oppositely facing surfaces of said helical flights and to said piloting means.

14. A footing auger according to claim 8, wherein said footing auger is made of hardened steel.

15. A footing auger according to claim 8, wherein said blade extensions have an inside edge attached to said pilot, an outside edge generally greater in length than said inside edge located at said helical flight outer radius, a base edge attached to said terminal end of said helical flight and a forward cutting edge extending from said inside edge to said outside edge.

16. A footing auger according to claim 15, wherein said blade extensions are made of hardened carbon steel and said base edge of each said blade extension is welded to said oppositely facing surface of each said helical flight.

17. A footing auger according to claim 8, wherein said forward cutting edge slopes forwardly and away from said piloting means.

* * * * *